US008458825B2

(12) United States Patent
Peng et al.

(10) Patent No.: US 8,458,825 B2
(45) Date of Patent: Jun. 11, 2013

(54) SPA JET WITH SCREW IN JET BARREL

(75) Inventors: Xue Wen Peng, Zhongshan (CN); John Keirstead, Zhongshan (CN); Kerry Harbarenko, Zhongshan (CN); Joe Hoover, Zhongshan (CN); Xue Wen Liu, Zhongshan (CN)

(73) Assignee: Guangzhou Rising Dragon Electronics & Plastics Technology Co. Ltd., Guangdong (CN)

( * ) Notice: Subject to any disclaimer, the term of this patent is extended or adjusted under 35 U.S.C. 154(b) by 540 days.

(21) Appl. No.: 12/267,293

(22) Filed: Nov. 7, 2008

(65) Prior Publication Data

US 2009/0133188 A1 May 28, 2009

(30) Foreign Application Priority Data

Nov. 9, 2007 (CN) ..... 2007 2 0059371 U

(51) Int. Cl.

| | |
|---|---|
| ***B05B 1/02*** | (2006.01) |
| ***A47K 3/10*** | (2006.01) |
| ***A61H 33/00*** | (2006.01) |
| ***E04H 4/12*** | (2006.01) |

(52) U.S. Cl.

USPC ..... 4/541.6; 4/492; 239/428.5

(58) Field of Classification Search

USPC ..... 4/541.6, 492; 239/428.5, 101, 237, 239/240, 381, 399, 407, 408, 410, 412

See application file for complete search history.

(56) References Cited

U.S. PATENT DOCUMENTS

| | | | | | |
|---|---|---|---|---|---|
| 3,067,435 | A | | 12/1962 | Nash | |
| 3,724,757 | A | * | 4/1973 | Hunter | 239/205 |
| 4,190,207 | A | * | 2/1980 | Fienhold et al. | 239/381 |
| 4,204,646 | A | * | 5/1980 | Shames et al. | 239/381 |
| 4,391,005 | A | * | 7/1983 | Goettl | 4/490 |
| 4,408,721 | A | * | 10/1983 | Cohen et al. | 239/417 |
| 4,541,780 | A | | 9/1985 | Moreland | |
| 4,542,853 | A | | 9/1985 | Diamond | |
| 4,542,854 | A | | 9/1985 | Mathis | |
| 4,559,653 | A | * | 12/1985 | Mathews | 4/541.6 |

(Continued)

FOREIGN PATENT DOCUMENTS

| | | | |
|---|---|---|---|
| CA | 2644557 C | * | 1/2012 |
| WO | WO 2011147495 A1 | * | 12/2011 |

OTHER PUBLICATIONS

Waterway Polyjet Series as listed on p. 2 of 1999 Waterway Catalogue.

(Continued)

*Primary Examiner* — Basil Katcheves
*Assistant Examiner* — Rodney Mintz
(74) *Attorney, Agent, or Firm* — Bryan Cave LLP

(57) ABSTRACT

A jet assembly has internals rotatably and releaseably fit to a jet body, such as that for a spa. The internals have a barrel housing, a rotor and a barrel inlet. The internals as screwed into the jet body. A first threaded portion outside the barrel threadably engages second threaded portion inside the jet body wherein the internals have delimited rotation therein to align and misalign the barrel inlet from a body inlet on the jet body to control flow on and off respectively. The threaded portion within the jet body can be a locking ring affixed therein by fasteners or integral with the jet body. Rotation can be delimited by a projection on the barrel and a cooperating annular delimiting surface on the locking ring, such as circumferentially-spaced detents.

26 Claims, 6 Drawing Sheets

U.S. PATENT DOCUMENTS

| | | | | |
|---|---|---|---|---|
| 4,592,100 | A * | 6/1986 | Robertson et al. | 4/541.4 |
| 4,637,080 | A * | 1/1987 | Hutchinson | 4/541.4 |
| 4,671,463 | A * | 6/1987 | Moreland et al. | 239/428.5 |
| 4,731,887 | A * | 3/1988 | Henkin et al. | 4/541.4 |
| 4,742,965 | A * | 5/1988 | Messinger et al. | 239/417.3 |
| 4,805,664 | A * | 2/1989 | Mattei et al. | 137/543.23 |
| 4,985,943 | A * | 1/1991 | Tobias et al. | 4/541.6 |
| 5,090,624 | A * | 2/1992 | Rogers | 239/381 |
| 5,142,714 | A * | 9/1992 | Klotzbach | 4/541.6 |
| 5,269,029 | A * | 12/1993 | Spears et al. | 4/541.6 |
| 5,353,447 | A | 10/1994 | Gravatt | |
| 5,386,598 | A * | 2/1995 | Mersmann | 4/541.4 |
| 5,587,023 | A * | 12/1996 | Booth | 134/32 |
| 5,810,262 | A * | 9/1998 | Ton | 239/428.5 |
| 5,862,545 | A * | 1/1999 | Mathis et al. | 4/662 |
| 5,915,849 | A | 6/1999 | Dongo | |
| 5,920,925 | A * | 7/1999 | Dongo | 4/541.6 |
| 6,164,562 | A * | 12/2000 | Wu | 239/237 |
| 6,178,570 | B1 * | 1/2001 | Denst et al. | 4/541.6 |
| 6,263,522 | B1 | 7/2001 | Dongo et al. | |
| 6,322,004 | B1 * | 11/2001 | Perdreau et al. | 239/428.5 |
| 6,453,484 | B1 * | 9/2002 | Pinciaro | 4/541.6 |
| 6,470,509 | B1 * | 10/2002 | Ayeni | 4/541.6 |
| 6,491,238 | B1 * | 12/2002 | Swanson et al. | 239/587.4 |
| 6,499,672 | B1 * | 12/2002 | Sesser | 239/222.11 |
| 6,536,809 | B2 * | 3/2003 | Marty et al. | 285/261 |
| 6,745,413 | B2 * | 6/2004 | Pinciaro | 4/541.6 |
| 6,766,967 | B2 * | 7/2004 | Harris et al. | 239/251 |
| 6,848,637 | B2 | 2/2005 | Holtsnider | |
| 6,860,437 | B1 * | 3/2005 | Amendt et al. | 239/383 |
| 6,889,916 | B2 * | 5/2005 | Loyd et al. | 239/261 |
| 7,427,038 | B2 * | 9/2008 | Wang et al. | 239/240 |
| 7,445,164 | B2 * | 11/2008 | Liaw | 239/240 |
| 7,571,867 | B2 * | 8/2009 | Hu | 239/383 |
| 7,644,452 | B2 | 1/2010 | Colin | |
| 7,654,474 | B2 * | 2/2010 | Cordua | 239/457 |
| 7,819,338 | B1 * | 10/2010 | Goettl | 239/205 |
| 7,832,029 | B2 * | 11/2010 | Holtsnider | 4/541.6 |
| 7,866,626 | B1 * | 1/2011 | MacLean-Blevins | 251/61 |
| 7,950,077 | B2 * | 5/2011 | Santamarina et al. | 4/541.6 |
| 7,979,924 | B1 * | 7/2011 | Goettl | 4/490 |
| 8,006,919 | B2 * | 8/2011 | Renquist et al. | 239/240 |
| 8,092,410 | B2 * | 1/2012 | Colin | 601/160 |
| 8,250,682 | B2 * | 8/2012 | Mjelde et al. | 4/492 |
| 8,272,079 | B2 * | 9/2012 | Long | 4/541.1 |
| 2003/0089797 | A1 * | 5/2003 | Buck | 239/261 |
| 2003/0146301 | A1 * | 8/2003 | Sun et al. | 239/399 |
| 2005/0039251 | A1 * | 2/2005 | Colin | 4/541.6 |
| 2005/0050627 | A1 * | 3/2005 | Ayeni et al. | 4/541.6 |
| 2006/0015997 | A1 * | 1/2006 | Barnes | 4/507 |
| 2006/0124181 | A1 * | 6/2006 | Chen | 137/625.41 |
| 2006/0230518 | A1 * | 10/2006 | Holtsnider et al. | 4/541.6 |
| 2007/0033725 | A1 * | 2/2007 | Holtsnider | 4/541.6 |
| 2007/0203439 | A1 * | 8/2007 | Boyd et al. | 601/162 |
| 2007/0226893 | A1 * | 10/2007 | Edris | 4/541.6 |
| 2008/0315015 | A1 * | 12/2008 | Hu | 239/381 |
| 2009/0094736 | A1 * | 4/2009 | Booth et al. | 4/541.6 |
| 2009/0165283 | A1 * | 7/2009 | Edris | 29/525.01 |
| 2009/0188993 | A1 * | 7/2009 | Brown et al. | 239/240 |
| 2009/0230671 | A1 * | 9/2009 | Stein et al. | 285/8 |
| 2010/0193603 | A1 * | 8/2010 | Lo | 239/240 |
| 2011/0084151 | A1 * | 4/2011 | Dunn et al. | 239/240 |
| 2012/0272447 | A1 * | 11/2012 | Fleischer | 4/541.6 |
| 2013/0048756 | A1 * | 2/2013 | Drury et al. | 239/428.5 |
| 2013/0075496 | A1 * | 3/2013 | Hart et al. | 239/428.5 |

OTHER PUBLICATIONS

Waterway Quad Jet Series as listed on p. 15 of 1999 Waterway Catalogue.

Waterway Jumbo Jet Series as listed on p. 16 of 1999 Waterway Catalogue.

Correspondence dated Nov. 16, 2010, from Jaye G. Heybl referring to documents.

Correspondence dated Feb. 28, 2011, from Jaye G. Heybl referring to documents.

* cited by examiner

SPA JET WITH SCREW IN JET BARREL

FIELD OF THE INVENTION

The invention relates to spa jets used in spas, pools or any other hydrotherapy equipment and more particularly relates to spa jets having a jet barrel releasably and threadably affixed in a jet body.

BACKGROUND OF THE INVENTION

A conventional jet assembly includes a removable jet internals including a face, a rotor, a barrel, and a barrel end piece. The jet internals are removeably fit to a jet body. A lock ring is installed inside the jet body. The face and barrel are fixed together. Spring clips extending from barrel join to the lock ring. Inlet ports on an end of the barrel cooperate with the jet body to enable on/off the flow when the jet internals are rotated. Further, air is automatically drawn in via an air-inlet port on jet body by a venturi action.

Currently, an existing problem with the conventional jet assemblies is that the jet internals, in particular the clips, tend to fail by popping out of the jet body over time due to continuous vibration, chemical corrosion, raw material limitations and high water pressure.

There is a need for an improved arrangement for releasably affixing the jet internals to the jet body.

SUMMARY OF THE INVENTION

Generally, the present invention provides an improved rotatable connection between the jet internals and jet body that solves the aforementioned jet internal failure problems while continuing to enable full control of open/close of water flow by rotation of the jet internals.

In one aspect, the invention comprises a rotatable connection threadable connection between jet internals and a jet body. A jet assembly is provided comprising internals having a barrel housing, a rotor and a barrel inlet and having a jet body for receiving the internals. The jet body has a body inlet for introducing water flow. The barrel comprises a first threaded portion and the jet body comprises a second threaded portion wherein the barrel is screwed in or threadably connected to the jet body for delimited rotation of the barrel to align and misalign the barrel inlet from the body inlet to control flow on and off respectively.

A locking ring can be fit or integrated with the jet body which comprises the second threaded portion and means for delimiting the rotation, such as a projection on the barrel and one of more detents on in the locking ring.

In another aspect the invention comprises a jet assembly for a spa comprising a jet body adapted for support in a spa and having a body inlet for receiving a water flow and jet internals comprising a barrel housing, a rotor and a barrel inlet, the jet internals being rotatably connected within the jet body. A first threaded portion outside the barrel and a second threaded portion inside the jet body enable threadably connection to the jet body for delimited rotation of the barrel to align and misalign the barrel inlet from the body inlet to control flow on and off respectively.

DETAILED DESCRIPTION OF THE PREFERRED EMBODIMENTS

Figure 1:
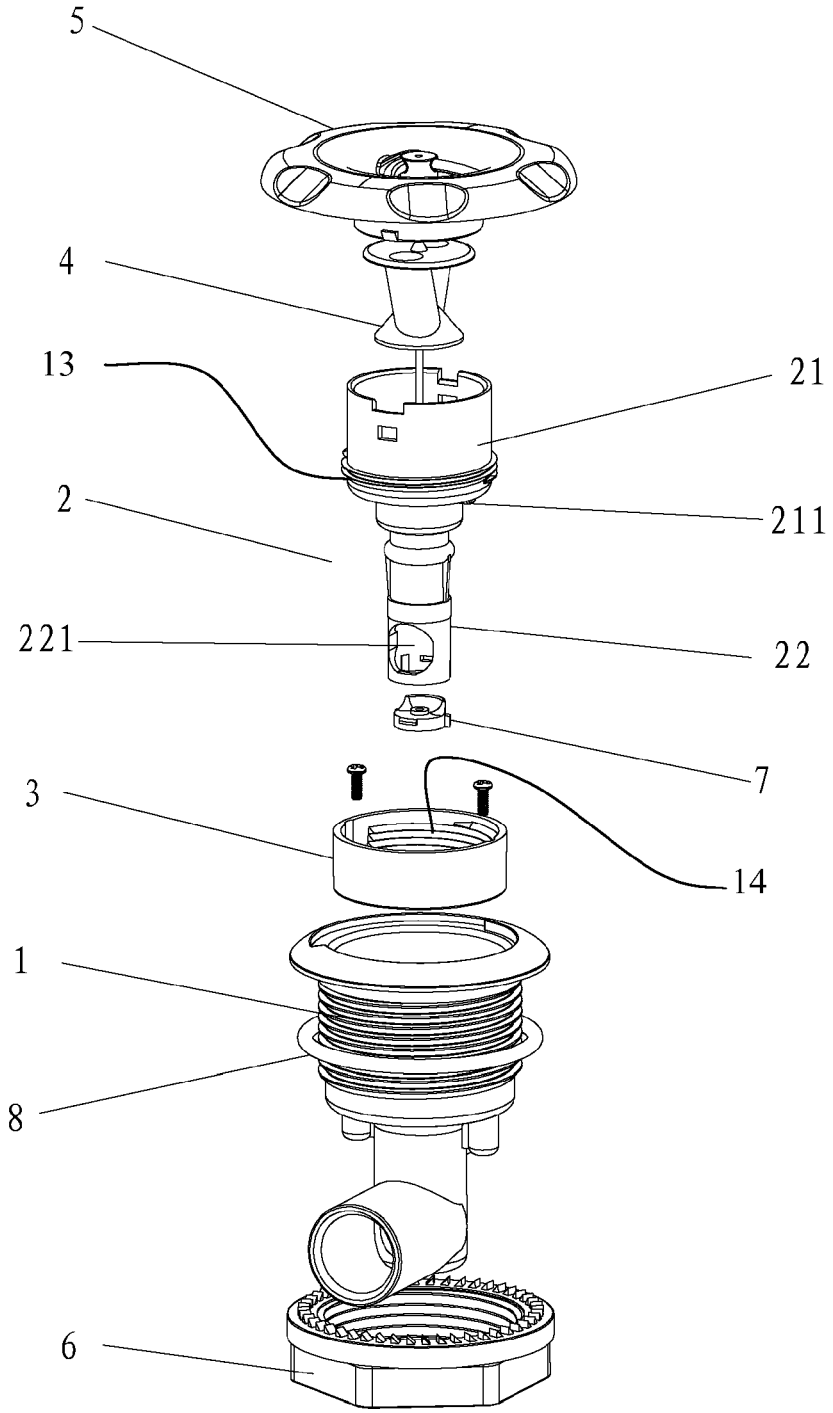
FIG. 1 is an exploded perspective view of one embodiment of a spa jet including jet internals and the jet body.
Figure 2:
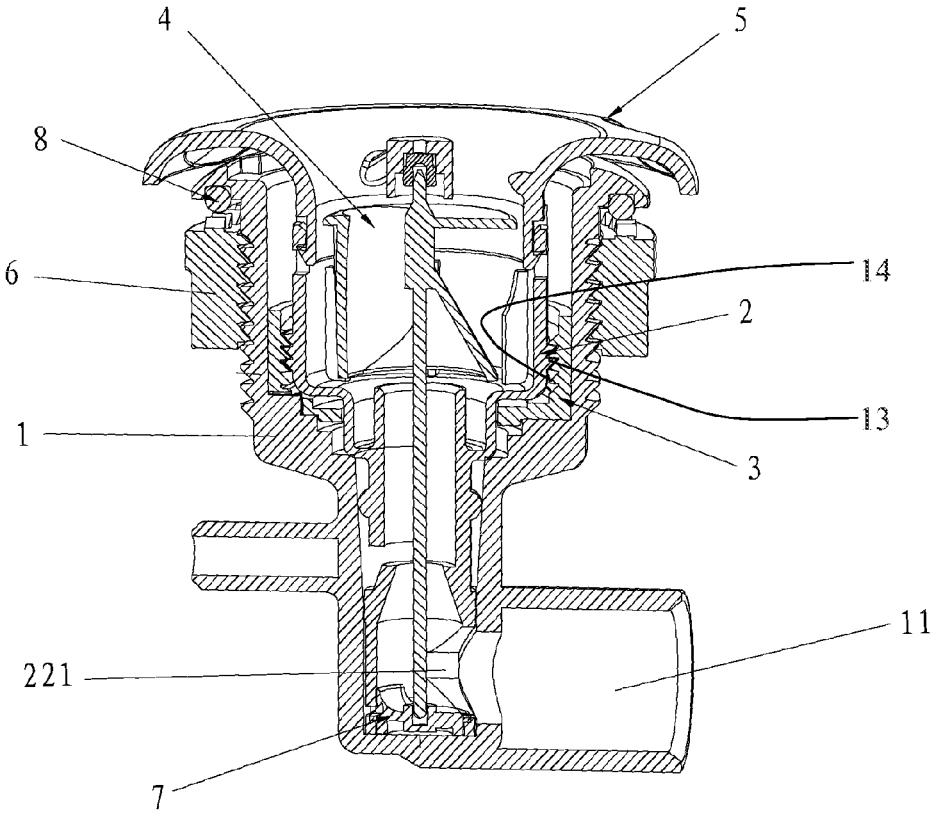
FIG. 2 is a cross sectional view of the assembled jet according to FIG. 1.

FIGS. 1 and 2 illustrate a spa jet having jet internals comprising face 5, rotor 4, barrel housing or barrel 2, and a barrel end piece 7. Further, the spa jet comprises a jet body 1 fit with a lock ring 3, the jet body being adapted for support in a spa by an O-ring 8 and nut 6. The lock ring 3 is installed in the jet body 1. The face 5 and the barrel 2 are fixed together. Barrel 2 comprises a barrel cavity 21 for housing a rotor 4 supported rotatably therein by means such as a spindle pin, and a barrel inlet or lower inlet end 221 for receiving a flow of water from the jet body 1.

The jet internals are rotatably mounted within the jet body 1. A cooperating threaded connection having a first threaded portion 13 outside of the barrel 2 and a second threaded portion 14 inside the lock ring 3 for screwing in or rotatably securing the barrel 2 to the jet body 1. The first threaded portion 13 can be about the barrel cavity 21. Once threaded together, cooperating, rotational delimiting members on the barrel 2 and the jet body 1 delimit rotation between on (flowing) and off positions.

Figure 3:
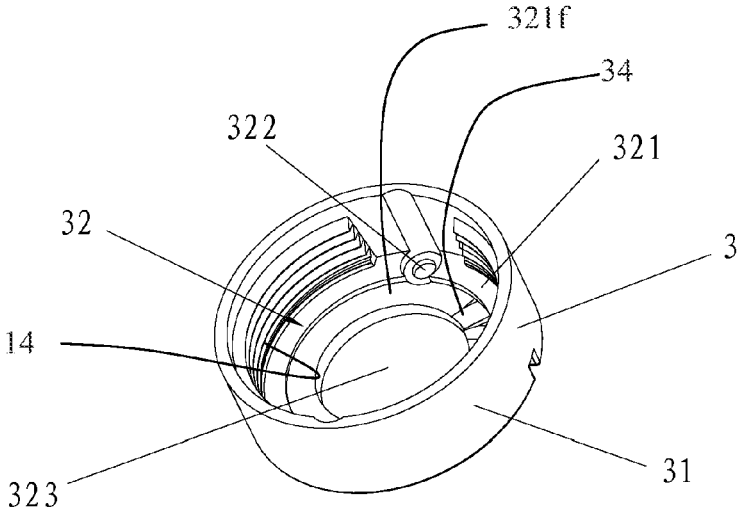
FIG. 3 is a perspective view of a lock ring.

With reference to FIG. 3, one embodiment of the lock ring 3 comprises a tubular component having an annular ring 31 and a baseplate 32. The lock ring comprises a central passage 323 which allows the lower inlet end 221 of the barrel 2 to pass therethrough. The central passage is formed with the second threaded portion 14. The baseplate 32 forms a shoulder or an annular delimiting surface 321*f*, such as in an annular groove 321, located axially below the second threaded portion 14, and further supports one or more screw holes 322 for connecting the lock ring 3 and the jet body 1. Screws (FIG. 1) through the screw holes 322 install the lock ring 3 in the jet body 1.

Figure 6:
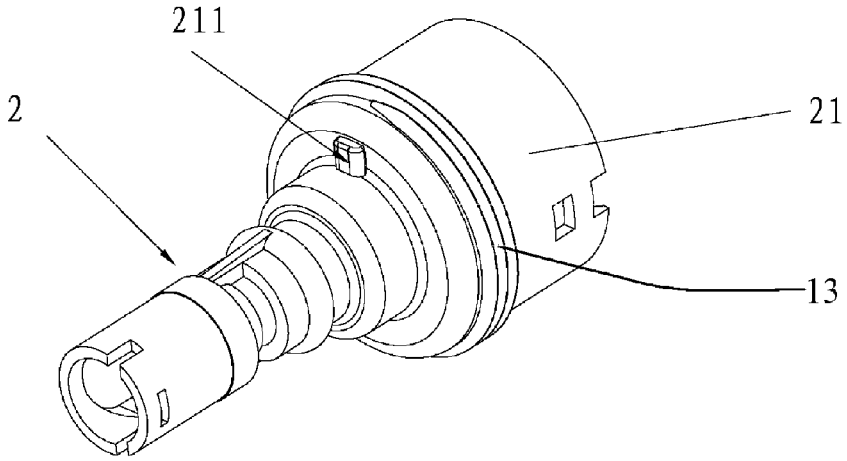
FIG. 6 is a perspective view of a jet barrel according to FIG. 1.

With reference to FIGS. 1, 3 and 6, there are one or more first delimiting members such as a directional projection 211 extending axially from an underside of the barrel cavity 21 for cooperating engagement with circumferentially-spaced and second delimiting members such as axially extending detents 34 of the annular groove 321 of the lock ring 3. It is understood that the first and second delimiting members on the barrel and jet body can be any one of cooperating projections/depressions, depressions/projection or projections/projections.

As shown, the first delimiting members are one or more axial projections or directional projections 211 and the second delimiting members are one or more detents 34 which rotationally position the barrel 2 relative to the jet body 1. The detents 34 are spaced circumferentially as stops or limits to control positioning of the barrel 2 and inlet end 221 for water control and extend axially to releasably engage the directional projection 211. In the embodiment of FIG. 1, the directional projection 211 is located axially below the first threaded portion 13 for cooperation with an annular delimiting surface located below the second threaded portion 14, such as on baseplate 32.

In use, the barrel 2 is rotated at the threaded connection to activate the jet. An example of such delimited rotation can be about ¼ turn between open and closed positions. As the barrel 2 is rotated, the directional projection 211 or catch moves circumferentially along the annular groove 321, and may engage one or more of the detents 34 formed therein, such as to orient the barrel inlet 221 to match the inlet 11 on the jet body 1 or to mismatch the barrel inlet to achieve an on/off function respectively. The barrel 2 may also be rotated to any intermediate and circumferential position therebetween.

With reference to FIGS. 4, 5, 8 and 9, in another embodiment, the lock ring 3 can be composed of an annular delimiting surface such as an annular ring 31 formed by an upper annular face 31*f* and a flange 33. The flange 33 is fit with screw holes 322 which enable using screws to install the lock ring 3 into the jet body 1 with the upper annular face 31*f* facing the barrel 2. The upper annular face 31*f* forms a counterpart to the annular delimiting surface 321*f* of the annular groove 321 of the previous embodiment. In this embodiment, the directional projection 211 is located axially above the first threaded portion 13 for cooperation with the annular delimiting surface located above the second threaded portion 14, such as the upper annular face 31*f*.

The upper annular face 31*f* is fit with one or more detents 34 which, in this embodiment, protrude to extend axially. A cooperating directional projection 211 extends axially from an underside of the barrel cavity 21 for cooperating engagement with, and between, detents 34 of the upper annular face 31*f* of the lock ring 3 to control water on/off.

Figure 7:
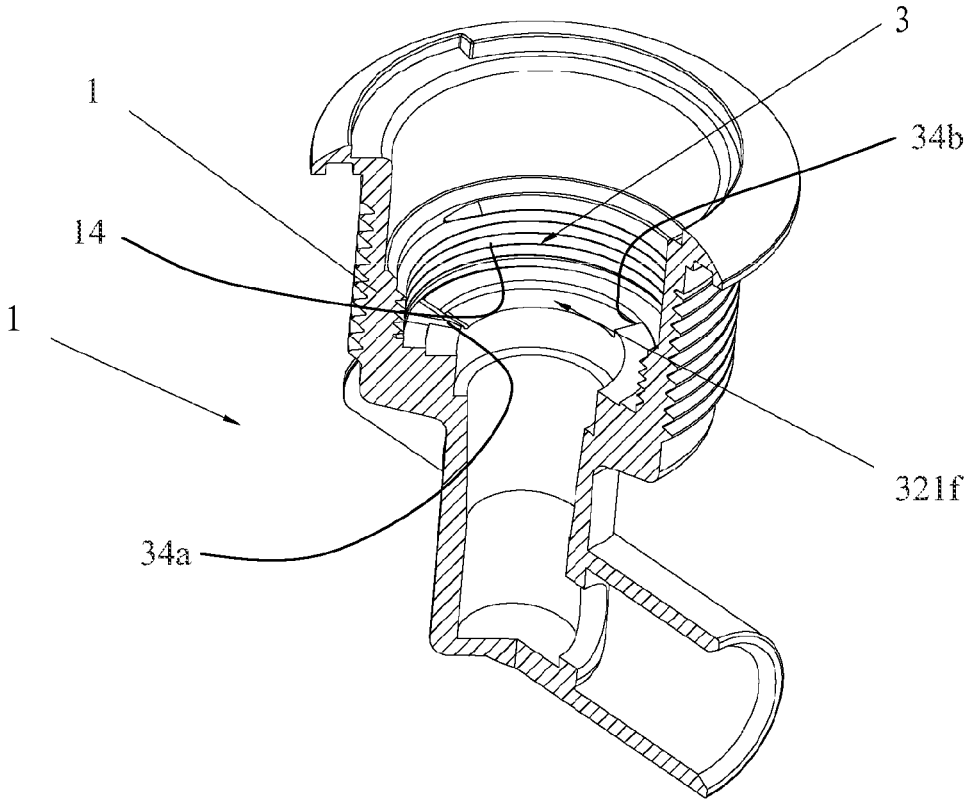
FIG. 7 is a perspective view of an embodiment of a jet body integrating the lock ring with the jet body.
Figure 8:
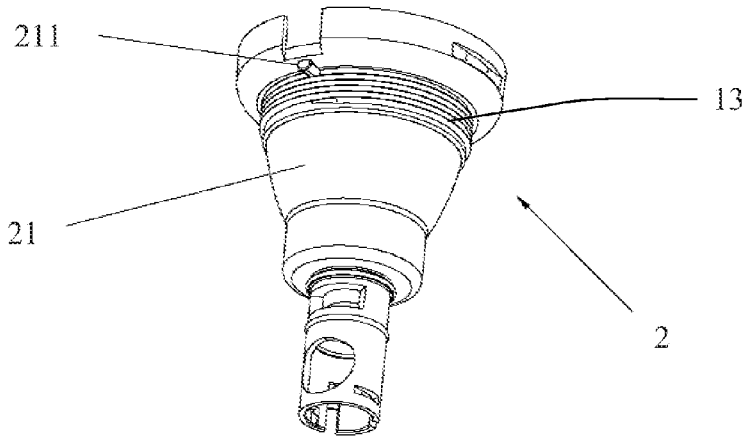
FIG. 8 is a perspective view of an embodiment of a jet barrel according to FIG. 4.

In another embodiment, and with reference to FIG. 7, the lock ring 3 and the jet body 1, according to FIG. 1, can be molded together as a unitary assembly.

Figure 4:
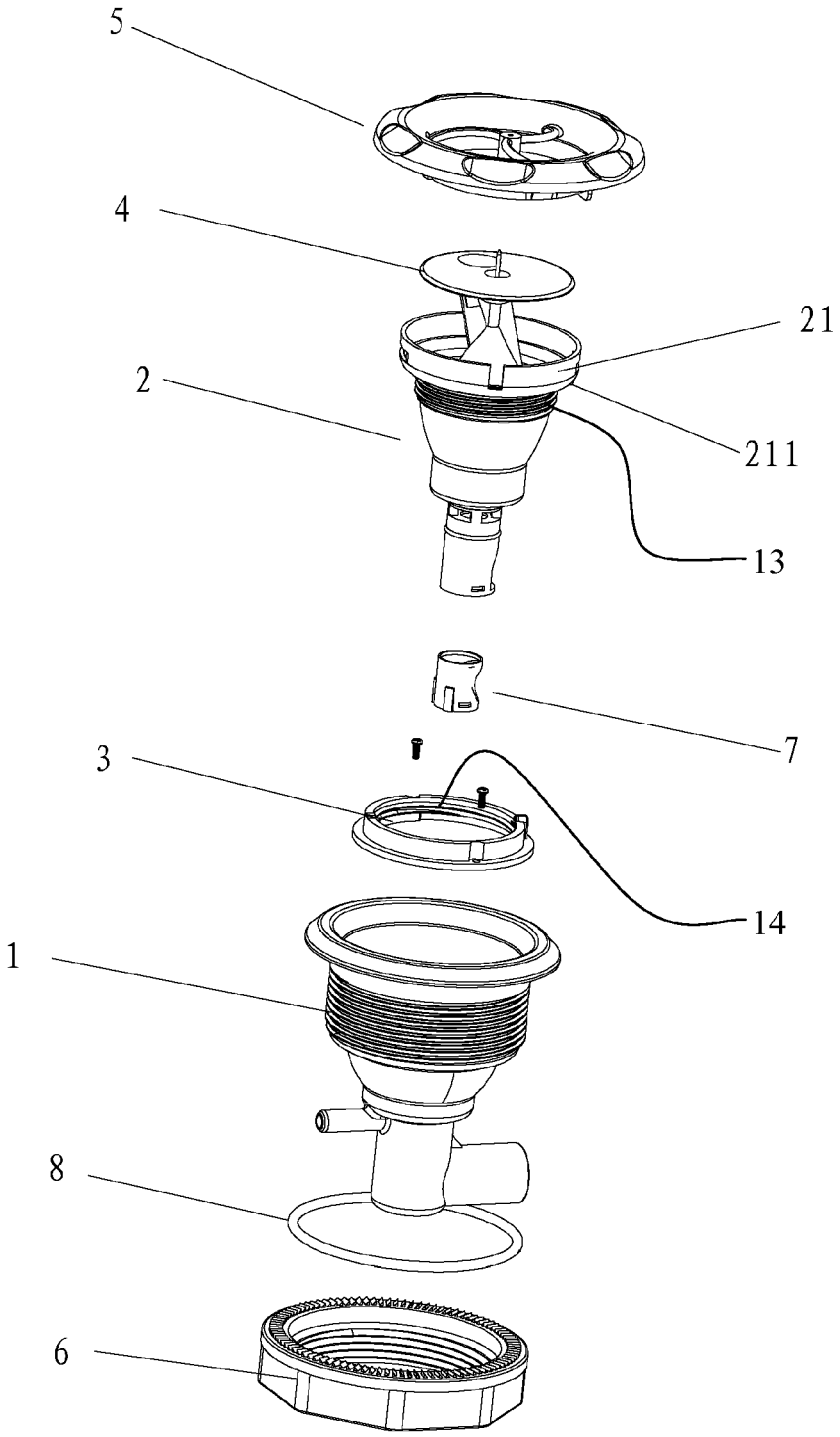
FIG. 4 is an exploded perspective view of another embodiment of a spa jet including jet internals and the jet body.
Figure 5:
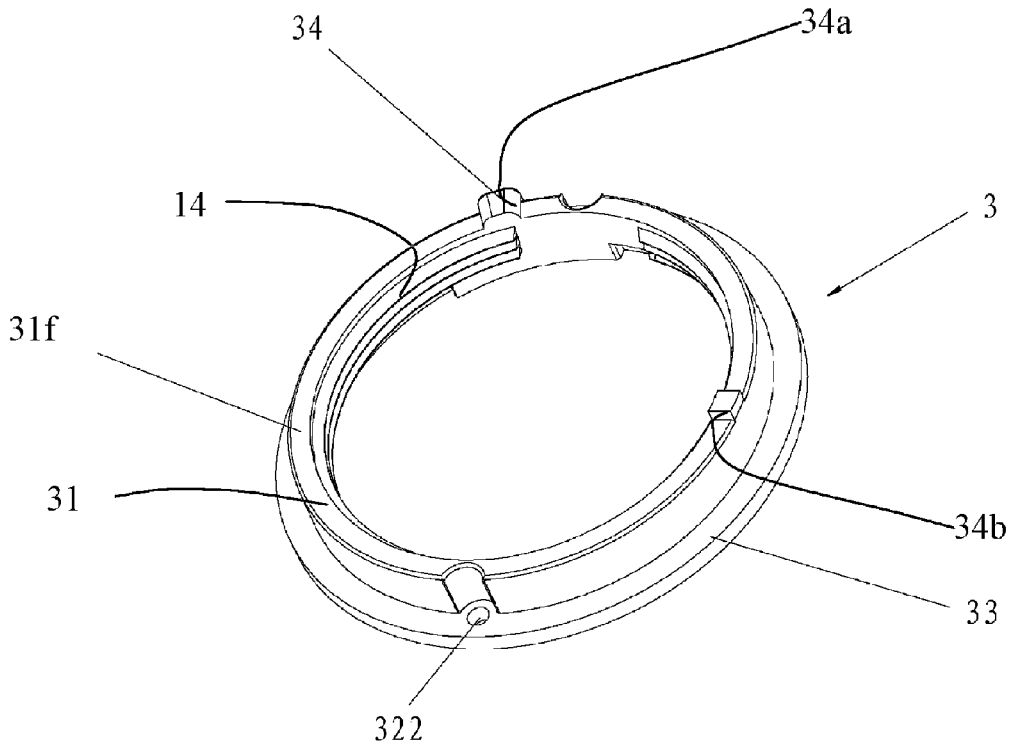
FIG. 5 is a perspective view a lock ring according to FIG. 4.
Figure 9:
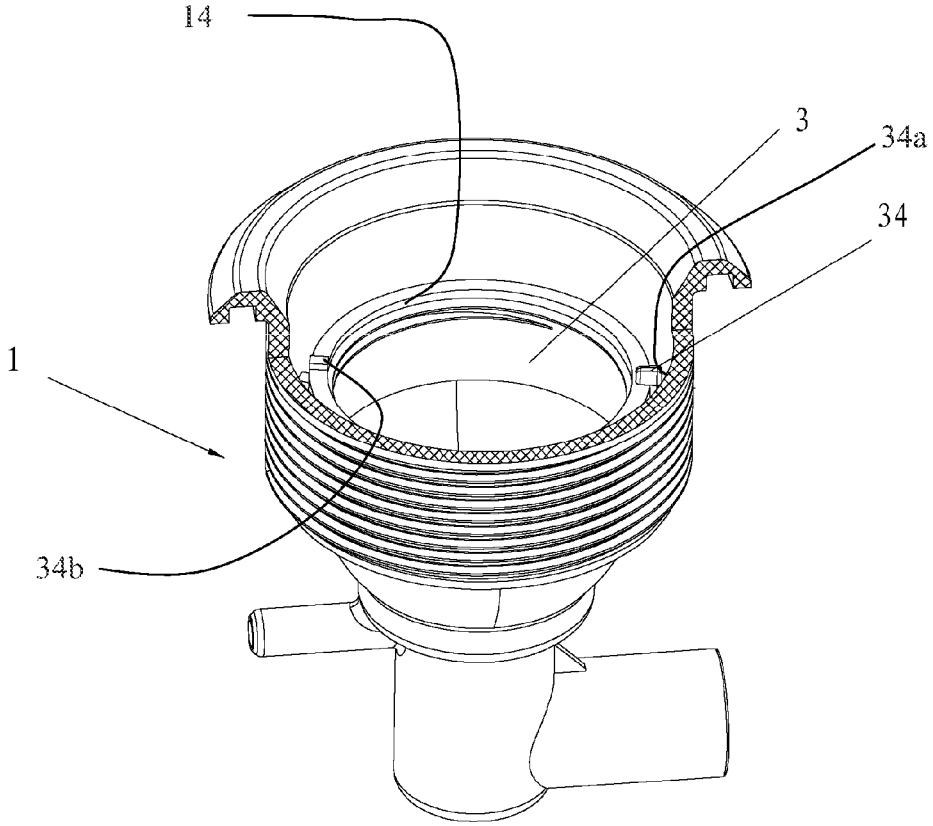
FIG. 9 is a perspective view another embodiment of a jet body.

In another embodiment, and with reference to FIG. 9, the lock ring 3 and the jet body 1, according to FIG. 4, can be molded together as a unitary assembly.

Assembly and Operation

As shown in either FIG. 1 or 4, to assemble a spa jet, a lock ring 3 is fit to the jet body 1, either by screws, mounted or formed therein. Typically, the jet body has already been pre-installed into a side wall of a spa tub. To install the barrel 2 in the jet body, the barrel 2 is threaded into the lock ring 3. As the barrel 2 is threaded deeper into the jet body 1, the directional projection 211 meets a detent 34 of the annular groove 321 or surface of the annular ring 31 (the annular delimiting surfaces of the first or second embodiment respectively, see FIGS. 1,4). The barrel is further threaded into the jet body 1 to let the directional projection 211 elastically engage and pass by a first detent 34*a*. This positions the barrel 2 into a rotationally adjustable position between a first detent 34*a* and a second detent 34*b*. Having passed by the first detent 31*a*, the barrel inlet 221 is initially positioned mismatched from the jet body inlet 11 and in the closed position.

A further delimited threaded rotation, such as between the two detents 34*a*,34*b*, orients the barrel inlet 221 to match with the jet body inlet 11 at which time the directional projection 211 engages the a second detent 34*b* in the full open position. The directional projection can move in the annular groove 321 or along the annular ring 31 between two detents 34*a*,34*b* to turn the flow on and off.

To remove the internals, the barrel is threaded out with sufficient strength to force directional projection 211 to cross the first detent 34*a* after which further un-threading permits removal of the internals. This design avoids a popping out of the internals by mispositioning.

The detents 34*a*,34*b* can be shaped to ease assembly and resist inadvertent disassembly. The first detent 34*a* has a directional function. During assembly, when the barrel's directional projection 211 first meets the first detent 34*a*, there is a ramp or slope to let it cross easily and access the annular groove 321 behind the first detent 34*a* which delimits the rotational movement. The first detent can have a perpendicular surface at the other side of the first detent 34*a*. Accordingly, as the internals are rotated within the annular groove 321, the directional projection 211 on the barrel 2 moves within the groove and is limited by the perpendicular surface of the first detent 34*a*. Accordingly, the disassembly of the barrel 2 from the jet body requires greater rotational force. This avoids inadvertent disassembly and pop out.

The invention claimed is:

1. A jet assembly system for controlling a water flow in a spa, comprising:

a jet body adapted for support in the spa and having a body inlet for receiving the water flow;

jet internals comprising a barrel housing, a rotor rotatably supported therein and a barrel inlet, the jet internals being rotatably connected within the jet body;

a first threaded portion outside the barrel housing for rotation therewith;

an axial projection on the barrel housing;

a lock ring fit to an inside of the jet body, the lock ring having a second threaded portion for cooperating with the first threaded portion, the lock ring including an annular delimiting surface comprising circumferentially-spaced detents that cooperate with the axial projection for delimited rotation of the barrel housing relative to the jet body to align and misalign the barrel inlet from the body inlet to control flow on and off respectively.

2. The jet assembly system of claim 1 wherein the lock ring is fit to the jet body using fasteners.

3. The jet assembly system of claim 1 wherein the lock ring further comprises:

a tubular component having an annular ring, a baseplate and a central passage formed with the second threaded portion, wherein the annular delimiting surface is formed on the baseplate.

4. The jet assembly system of claim 1 wherein the lock ring further comprises:

a tubular component having an annular ring and a central passage formed with the second threaded portion, wherein the annular delimiting surface is formed on the annular ring.

5. The jet assembly system of claim 1 wherein:

the axial projection is located axially below the first threaded portion; and the annular delimiting surface is located axially below the second threaded portion.

6. The jet assembly system of claim 1 wherein:

the axial projection is located axially above the first threaded portion; and the annular delimiting surface is located axially above the second threaded portion.

7. A jet assembly system comprising internals and a jet body for receiving the internals, the internals having at least a barrel housing having a barrel inlet, the jet body having a jet inlet, the jet assembly comprising:

a first threaded portion outside the barrel housing for rotation therewith;

an axial projection on the barrel housing;

a lock ring adapted for mounting to an inside of the jet body, the lock ring including a second threaded portion, the lock ring including an annular delimiting surface further comprising circumferentially-spaced, axially extending first and second detents;

wherein the first threaded portion cooperates with the second threaded portion for threadably connecting the barrel housing inside the jet body, rotational threading movement of the barrel housing therein causing the barrel housing to thread deeper into the jet body for engaging the axial projection with the first detent, the axial projection threading deeper to pass the first detent; and wherein further rotational threading movement of the barrel housing rotationally aligns and misaligns the barrel inlet relative to the jet inlet, the axial projection engaging between the first and second detents for delimiting the rotational threading movement therebetween to control flow on and off respectively.

8. The jet assembly system of claim 7 wherein the lock ring is mountable to the jet body using fasteners.

9. The jet assembly system of claim 7 wherein the lock ring further comprises:

a tubular component having an annular ring, a baseplate; and a central passage formed with the second threaded portion, wherein the annular delimiting surface is formed on the baseplate.

10. The jet assembly system of claim 7 wherein the lock ring further comprises:

a tubular component having an annular ring and a central passage formed with the second threaded portion, wherein the annular delimiting surface is formed on the annular ring.

11. The jet assembly system of claim 7 wherein:

the axial projection is located axially below the first threaded portion; and the annular delimiting surface is located axially below the second threaded portion.

12. The jet assembly system of claim 7 wherein:

the axial projection is located axially above the first threaded portion; and the annular delimiting surface is located axially above the second threaded portion.

13. A jet assembly system comprising:

a barrel housing having a rotor rotatably supported therein and a barrel inlet, the barrel housing having a first threaded portion outside the barrel housing for rotation therewith, the barrel housing including an axial projection;

a jet body having a body inlet; and a lock ring fit to an inside of the jet body, the lock ring having a second threaded portion for cooperating with the first threaded portion, the lock ring including an annular delimiting surface comprising circumferentially-spaced detents that cooperate with the axial projection for delimited rotation of the barrel housing relative to the jet body to align and misalign the barrel inlet from the body inlet to control flow on and off respectively.

14. The jet assembly system of claim 13 wherein the lock ring is fit to the jet body using fasteners.

15. The jet assembly system of claim 13 wherein the lock ring further comprises:

a tubular component having an annular ring, a baseplate and a central passage formed with the second threaded portion, wherein the annular delimiting surface is formed on the baseplate.

16. The jet assembly system of claim 13 wherein the lock ring further comprises:

a tubular component having an annular ring and a central passage formed with the second threaded portion, wherein the annular delimiting surface is formed on the annular ring.

17. The jet assembly system of claim 13 wherein:

the axial projection is located axially below the first threaded portion; and the annular delimiting surface is located axially below the second threaded portion.

18. The jet assembly system of claim 13 wherein:

the axial projection is located axially above the first threaded portion; and the annular delimiting surface is located axially above the second threaded portion.

19. A jet assembly system comprising:

a barrel housing having a rotor rotatably supported therein and a barrel inlet, the barrel housing having a first threaded portion outside the barrel housing for rotation therewith, the barrel housing including an axial projection; and a jet body having a body inlet, the jet body including a lock ring mounted to an inside of the jet body, the lock ring having a second threaded portion for cooperating with the first threaded portion, the lock ring including an annular delimiting surface comprising circumferentially-spaced detents that cooperate with the axial projection for delimited rotation of the barrel housing relative to the jet body to align and misalign the barrel inlet from the body inlet to control flow on and off respectively.

20. The jet assembly system of claim 19 wherein the lock ring is mounted to the jet body using fasteners.

21. The jet assembly system of claim 19 wherein:

the axial projection is located axially below the first threaded portion; and the annular delimiting surface is located axially below the second threaded portion.

22. The jet assembly system of claim 19 wherein:

the axial projection is located axially above the first threaded portion; and the annular delimiting surface is located axially above the second threaded portion.

23. A jet assembly system comprising:

a barrel housing having a rotor rotatably supported therein and a barrel inlet, the barrel housing having a first threaded portion outside the barrel housing for rotation therewith, the barrel housing including an axial projection; and a jet body having a body inlet, the jet body including a lock ring wherein the lock ring is molded to the jet body as a unitary assembly, the lock ring having a second threaded portion for cooperating with the first threaded portion, the lock ring including an annular delimiting surface comprising circumferentially-spaced detents that cooperate with the axial projection for delimited rotation of the barrel housing relative to the jet body to align and misalign the barrel inlet from the body inlet to control flow on and off respectively.

24. The jet assembly system of claim 23 wherein:

the axial projection is located axially below the first threaded portion; and the annular delimiting surface is located axially below the second threaded portion.

25. The jet assembly system of claim 23 wherein:

the axial projection is located axially above the first threaded portion; and the annular delimiting surface is located axially above the second threaded portion.

26. A jet assembly system for controlling a water flow in a spa, comprising:

a barrel housing having a rotor rotatably supported therein and a barrel inlet, the barrel housing having a first threaded portion outside the barrel housing for rotation therewith, the barrel housing including at least one barrel housing axial projection or depression; and a jet body having a body inlet, the jet body including a lock ring mounted to an inside of the jet body or molded to the jet body as a unitary assembly, the lock ring having a second threaded portion for cooperating with the first threaded portion, the lock ring including an annular delimiting surface, the annular delimiting surface having at least one circumferentially-spaced axial projection for cooperating with the at least one barrel housing depression or axial projection forming any one of cooperating projections/depressions, or projections/projections, or at least one circumferentially-spaced axial depression for cooperating with the at least one barrel housing axial projection for forming depressions/projections, for delimited rotation of the barrel housing relative to the jet body to align and misalign the barrel inlet from the body inlet to control the water flow.

* * * * *